United States Patent [19]

Marass

[11] Patent Number: 4,703,924

[45] Date of Patent: Nov. 3, 1987

[54] SHEET FEEDING APPARATUS WITH MECHANICAL PILE RETRACTION

[75] Inventor: Josef Marass, Seehausen, Fed. Rep. of Germany

[73] Assignee: George Spiess GmbH, Gersthofen, Fed. Rep. of Germany

[21] Appl. No.: 811,996

[22] Filed: Dec. 23, 1985

[30] Foreign Application Priority Data

Feb. 9, 1985 [DE] Fed. Rep. of Germany ..... 3504491

[51] Int. Cl.[4] ..... B65H 1/26; B65H 1/14

[52] U.S. Cl. ..... 271/9; 271/30.1; 271/158; 271/159; 271/162; 414/47; 414/118

[58] Field of Search ..... 271/157, 158, 159, 9, 271/30.1, 126, 147, 152, 153, 154, 155, 162, 156; 414/47, 118, 35, 113; 198/465.1, 346.1, 346.2; 104/172 BT, 172 C

[56] References Cited

U.S. PATENT DOCUMENTS

| | | | |
|---|---|---|---|
| 1,745,043 | 1/1930 | Romine | 414/35 |
| 2,094,826 | 10/1937 | Seybold | 271/158 |
| 2,639,824 | 5/1953 | Shannon et al. | 221/116 |
| 3,478,698 | 11/1969 | Jones | 104/172 BT |
| 4,153,242 | 5/1979 | Mizuma | 271/157 |
| 4,461,379 | 7/1984 | Papa | 198/465.1 |
| 4,489,821 | 12/1984 | Inaba et al. | 198/346.2 |

FOREIGN PATENT DOCUMENTS

| | | | |
|---|---|---|---|
| 1099556 | 2/1961 | Fed. Rep. of Germany | 271/159 |
| 1910160 | 10/1969 | Fed. Rep. of Germany | 271/158 |

*Primary Examiner*—Joseph J. Rolla
*Assistant Examiner*—Edward S. Ammeen
*Attorney, Agent, or Firm*—Collard, Roe & Galgano

[57] ABSTRACT

In order to achieve a mechanical retraction of piles in a sheet feeding apparatus with a lifting table, the lifting table can be lowered to the level of the floor and serves to take up, one at a time, a pile supporting surface loaded with a pile of sheets. Each of the pile supporting surfaces is in the form of a mobile carriage and there is a carriage retracting mechanism with a tugging device which is located on the floor. The tugging device has a reversible driving device, bridges a distance of at least one length of a carriage, is situated outside the surface area of the lifting table, and has at least one dog able to engage and disengage by the lifting or respectively lowering motion of the lifting table, with a coupling element. The coupling element has edges of contact parallel to the lifting or respectively lowering direction of the lifting table, is fixed to the carriage, and projects over the surface area of the lifting table when the carriage is on the lifting table.

16 Claims, 9 Drawing Figures

SHEET FEEDING APPARATUS WITH MECHANICAL PILE RETRACTION

BACKGROUND OF THE INVENTION

Figures 1, 2, 3, 4:
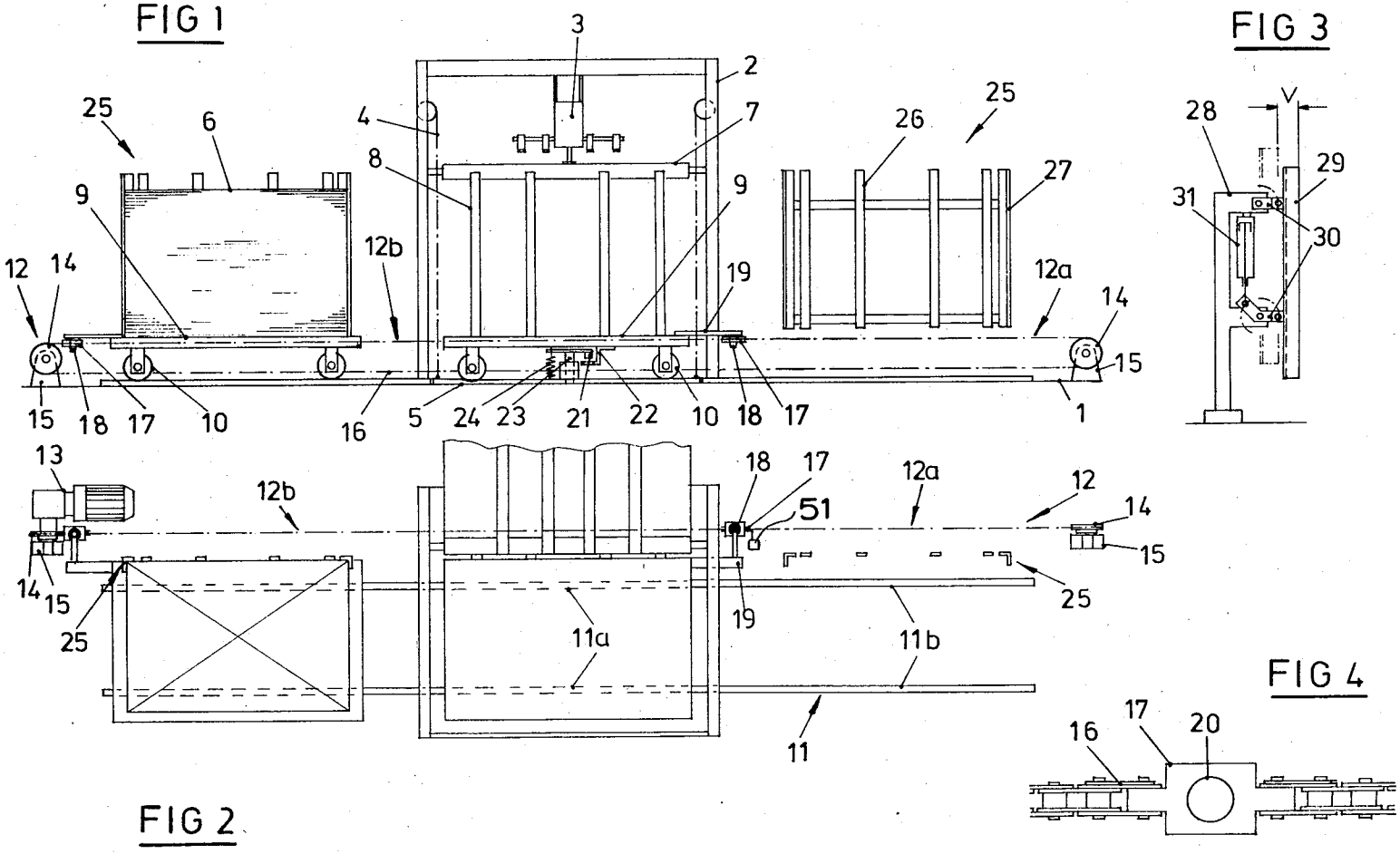

The present invention relates to a sheet feeding apparatus with a lifting table which can be lowered to the level of the floor and serves to take up, one at a time, a pile supporting surface loaded with a pile of sheets.

So far it has been necessary to position the pile supporting surface loaded with a pile, by means of a fork-lift operated manually or provided with a dirving engine, on the lifting table freed from the pile supporting surface finished off before. This process is not only very complicated and time consuming but may also prove to be very exhausting for the operating personnel as not only the finished-off pile supporting surface has to be removed but generally the position of the pile supporting surface loaded with a possibly heavy pile needs correcting several times before reaching its required position. The result thereof is a long interruption of production caused by the change of piles and an increased demand in manpower leading to an unfavorable economy.

SUMMARY OF THE INVENTION

Taking this prior art into account, one object of the invention is therefore to improve the previously proposed apparatus by simple and low-cost measures so that a mechanical pile retraction is achieved.

In order to effect this object, the pile supporting surface or surfaces respectively is/are in the form of a mobile carriage each and there is a carriage retracting mechanism with a tugging device which is located on the floor. The retracting mechanism has a reversible driving engine, bridges a distance of at least one length of a carriage, is situated outside the surface area of the lifting table, and has at least one dog able to engage and disengage, by the lifting or respectively lowering motion of the lifting table, with a coupling element which has edges of contqct parallel to the lifting or respectively lowering direction of the lifting table. The dog is fixed to the carriage, and projects over the surface area of the lifting table when the carriage is on the table.

These measures guarantee a mechanical pile retraction and thus not only liberate the operating personnel from a so far strenuous job but, at the same time, also considerably cut the time which is needed for chainging the piles. In accordance with a convenient further development of the invention, the mechanical retracting mechanism results in a high accuracy in positioning the piles as well as maintains a clear alignment of the edges of the piles and protects the piles material thus leading to a favorable accuracy and quality of production. The coupling element of the carriage which, when a pile is retracted, is in engagement with a dog, by having edges of contact parallel to the lifting or respectively lowering direction of the lifting table, makes sure that the carriage and the tugging device can be made to engage and disengage with each other by the lifting or respectively lowering motion of the lifting table, thus resulting in a simple design and low trouble incidence. At the same time, the change of piles can thus be easily controlled and also automated. An excellent economy is the main advantage of the invention.

In accordance with a convenient further development of the previously proposed invention, the carriage positioned on the lifting table may be locked to the latter by means of a bolt which is accommodated thereon, has edges of contact parallel to the lifting or respectively lowering direction of the lifting table, and can be made to engage and disengage with a counter-hold fixed to the carriage by the lifting or respectively lowering motion of the lifting table oppositely directed to the engagement of the dog with the coupling element. These measures conveniently result in an automatic locking or respectively unlocking of the carriage positioned on the lifting table and improve the overall safety.

As part of a convenient further development of the invention, the tugging device runs at right angles to the direction of motion of the sheets taken from the pile. Hereby, the two long sides of the frame of the feeding apparatus are conveniently available for the carriages to move in and out respectively. So the tugging device may have branches which are opposite each other in relation to the surface area of the lifting table, have at least one dog each, and may each have a carriage transportable by said dog. Therefore a particularly economical mode of operation ensues as, at the same time, the lifting table is liberated from a finished-off carriage, and a carriage loaded with a new pile moves in.

In accordance with the above measures, at least one branch of the tugging device may extend to a pre-piling device which is situated outside the lifting table and has front stops parallel to the front stops of the feeding apparatus and at least one side stop at right angles hereto.

The pre-piling device, as is generally known, guarantees an exact arrangement of the piles and thus a high accuracy of production. The accuracy of piling is strongly maintained by the carriage loaded with a pile in the pre-piling device, when piles are changed, moving out of the pre-piling device by means of the tugging device, and being positioned on the lifting table, thus enhancing the advantages of a pre-piling device.

As part of a convenient further development of the invention, the pre-piling device may have a frame with front and side stops which can be moved at right angles to the direction of motion of the tugging device by the measure corresponding to the width of the side stop. This makes sure that, when piles are changed, the edges of the pile set up in the pre-piling device, which rest against the stops of the pre-piling device, are released, which convienientyl protects the sheet material and maintains the accuray of piling.

It is convenient hereby to stagger the front stops of the feeding apparatus slightly forward in relation to the front stops of the pre-piling device, i.e. in the direction of motion of the sheets taken from the pile.

In accordance with a convenient further development of the invention, the tugging device may be in the form of a single-part circulating element which is located outside the surface area of the lifting table, at its ends runs over guide rollers situated at the same level, preferably has the form of a chain, and has two pre-piling devices opposite each other at the same staggering in relation to the lifting table as well as two carriages which, at the front sides turned away from each other, have a coupling element each. Hereby both pre-piling devices alternately may be supplied with the relative empty carriage so that the pre-piling takes place by turns on the left and respectively on the right of the frame of the feeding apparatus. At the same time, only one endless circulating element which may be situated with its whole length above the floor, is needed. The result is an easy design and uncomplicated control of the retracting mechanism. It is another advantage of the above measures that the lifting table, in its bottom position, can simply be put on the floor, and there is no need for a lowerable bridge under the lifting table as the retracting mechanism is only operated when the lifting table is at its bottom position.

In accordance with a further, in many cases especially convenient development of the invention, the tugging device has two single-part circulating elements which, in relation to the frame of the feeding apparatus, are opposite each other, run at right angles to the longitudinal axis of the frame of the feeding apparatus, are situated in the direction of the longitudinal axis of the frame of the feeding apparatus inside the inside diameter of the side openings of the frame of the feeding apparatus, with their ends run over guide rollers placed behind each other at the same level, are drivingly connected with each other by a close coupling, and have two dogs each which simultaneously run through the corresponding inner and respectively outer apexes of the two circulating elements. Hereby each carriage has two coupling elements of which the center-to-center distance at the apexes corresponds to the distance of the dogs which simultaneously run through the inner apexes facing each other of the two circulating elements. This working example only needs one pre-piling device thus guaranteeing an excellent use to capacity of this design. The previously described measures make sure, that, by means of a circulating element, a carriage loaded with a pile can move out of the pre-piling device and be positioned on the lifting table while, at the same time, by means of the other circulating element, the empty carriage is removed from the lifting table and driven out to the side opposite the pre-piling device, and that this empty carriage can be brought back to the pre-piling device under the lifting table as soon as the lifting table has enough ground clearance. In the middle position, the carriage is hereby conveniently transferred from one circulating element to the other on account of the concurrent distances of the dogs facing each other of the two circulating elements. In this middle position, in which the dogs are in their apex positon, it is also possible, with the tugging device at rest, to make the dogs and the coupling elements engage and respectively disengage with each other due to the lifting and lowering motion of the lifting table. For this purpose, there may be a bridge under the lifting table which can be lifted and respectively lowered by the thickness of the lifting table. The result hereof is that, even when the empty carriage moves back under the lifted lifting table, there is a ridgeless support of the carriage.

As part of a further development of the invention, the dogs may be in the form of pivots projecting laterally over the respective circulating element, and the coupling elements in the form of forks with a U-shaped cross section. This enables the fork-like coupling elements to move out due to the lifting or respectively lowering motion of the lifting table, as well as the pivot-like dogs to move in and respectively out of the fork-like coupling elements due to the circular motion at the guide rollers.

In accordance with a convenient further development of the invention, the two lateral circulating elements of the two-part tugging device, which have dogs, are drivingly connected with each other by means of a middle circulating element without dogs which preferably is also in the form of a chain and runs over guide rollers which, each together with an inner guide roller of the facing circulating element with dogs, are accommodated on a mutual shaft. This results in a mechanical driving connection of the two circulating elements with dogs and so in a simple synchronous drive of the two circulating elements in the same direction.

As part of a convenient further development of the invention, the coupling elements of the carriage may be situated at the middle longitudinal axis of the carriage so resulting in a centric traction.

As part of a convenient further development of the invention, the circulating element opposite the circulating element of the pre-piling device may be shorter than the latter and at the same ratio driven more slowly. So, comparatively little space is required on the side opposite the pre-piling device where there's no pre-piling device, which is favorable for the space required by the complete design.

Further useful effects of the invention and convenient outgrowths thereof will be seen from the following detailed account of several working examples to be described in detail with reference to the accompanying drawing.

Figure 5:
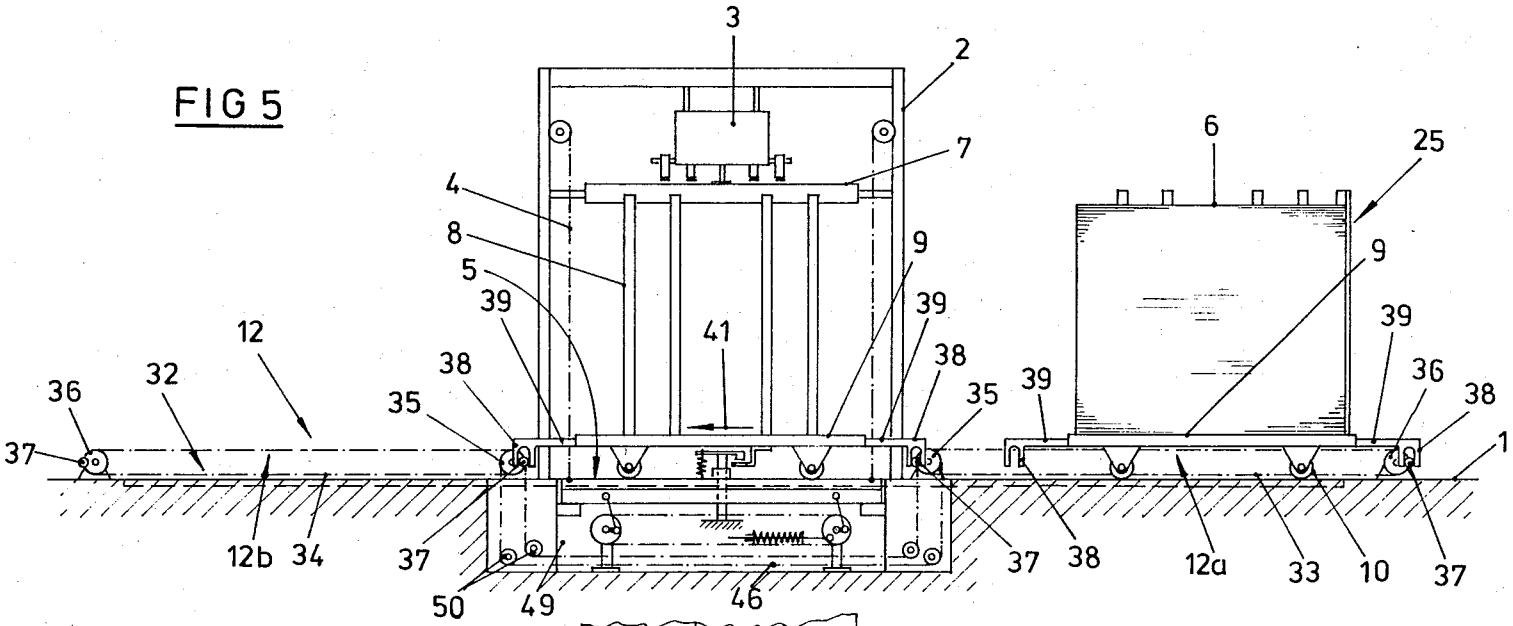
Figure 6:
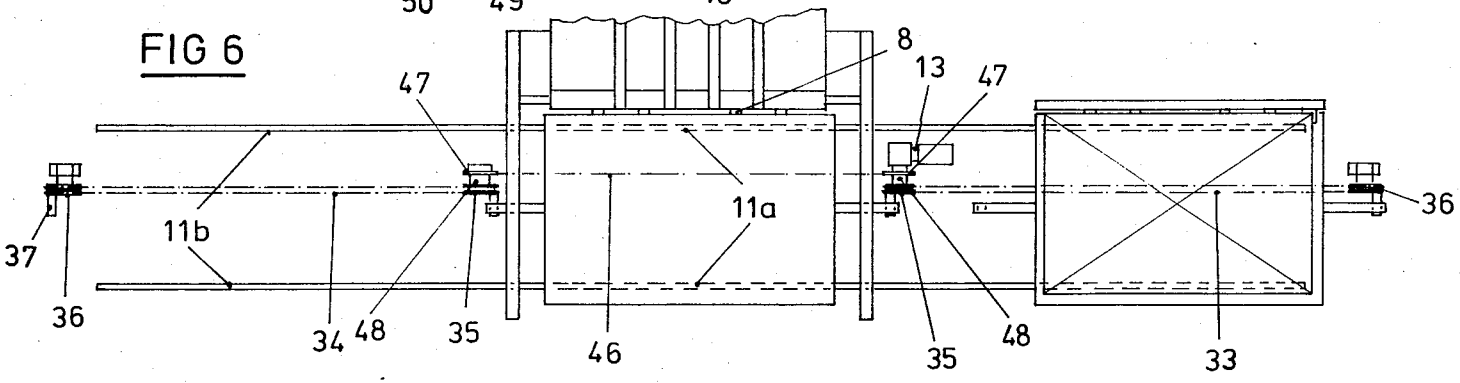
Figure 7:
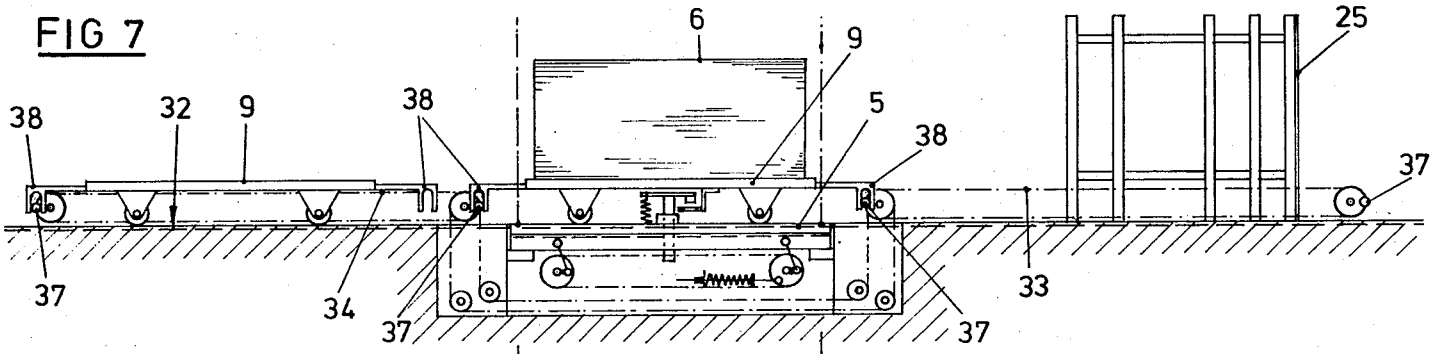
Figure 8:
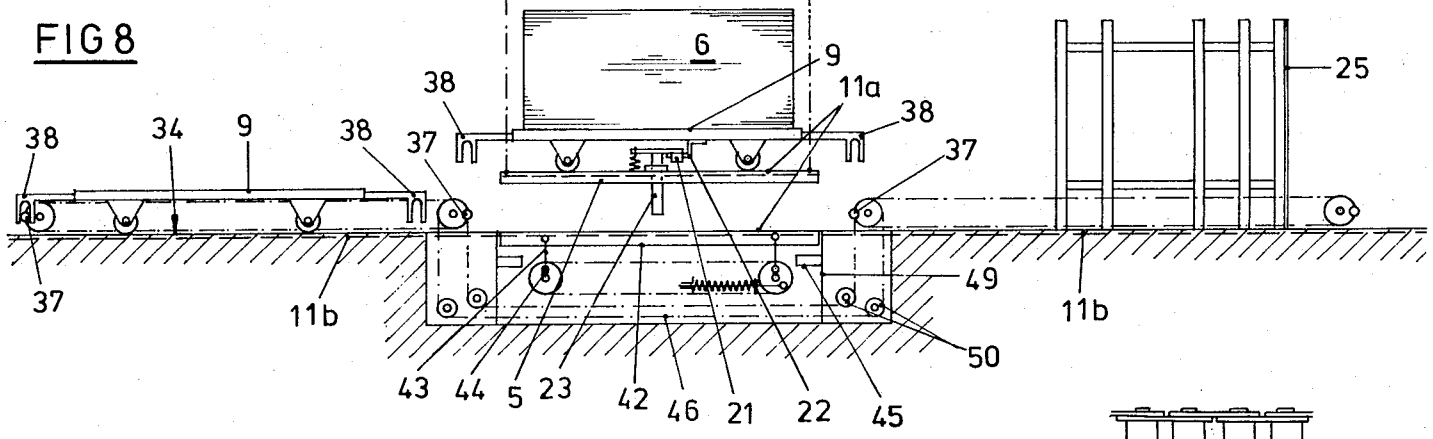
Figure 9:
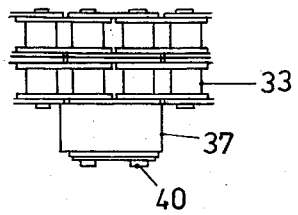

The figures in the drawing are:

FIG. 1, a back view of the sheet feeding apparatus with two pre-piling devices, FIG. 2, a top view of the design of FIG. 1, FIG. 3, a side view of a pre-piling device, FIG. 4, an enlarged view of a dog of FIG. 1, FIG. 5, a back view of another working example with only one pre-piling device in the position before a change of piles, FIG. 6, a top view of the design of FIG. 5, FIG. 7, the design of FIG. 5 in a working position during the change of piles, FIG. 8, the design of FIG. 5 in a position after the change of piles, and FIG. 9, an enlarged view of a dog of FIG. 5.

DETAILED ACCOUNT OF WORKING EXAMPLE OF THE INVENTION

The basic design and working of a sheet feeding apparatus being generally well known no further description of such an apparatus is called for at this juncture. The sheet feeding apparatus to be seen in the figures of the working examples has a portal-like machine frame 2 which is set up on the floor 1 of a machine room and accommodates a suction head 3 able to be moved back and forth in the direction of transport of the sheets, and a lifting table 5 arranged beneath it and suspended from a hoist 4 formed by lifting chains. While in operation, a pile supporting surface 9 can be positioned on said lifting table 5 accommodating a pile 6 of sheets the top one of which is each taken by means of the suction head 3 and conveyed to a belt table as indicated here by a feed roller 7. The space of the portal-like machine frame 2 respective to the lifting table 5 can generally be reached from outside via one back and two side openings and is bounded on the front side by front stops 8 against which the front edge of the upper part of the pile 6 lifted by means of the lifting table 5 can move.

When piles are changed, i.e. when a pile 6 is finished off and has to be replaced by a new pile 6, the empty pile supporting surface 9 is taken from the lifting table 5 and a new pile supporting surface 9 carrying a pile 6 is positioned on he lifting table 5. Such a working condition is shown in the FIGS. 1 and 5 with an old pile already finished off and respectively a new pile waiting. In order to mechanize the change of piles, the pile supporting surface 9 are in the form of mobile carriages provided with sleds or rolls 10 as shown here which can be retracted by means of a respective retracting mechanism, i.e. positioned on the lifting table 5. The retracting mechanism consists of rails 11 which run at right angles to the longitudinal axis of the feeding apparatus, i.e. at right angles to the direction of the suction head 3 moving back and forth, are supported on the floor, and on which run the carriage-like pile supporting surfaces 9, and of a tugging device 12 which can be made to engagae and disengage with the carriage-like pile supporting surfaces 9, is located on the floor, is paralle to the rails 11, and can be driven in ingoing and outgoing directions respectively by means of a driving device 13 here in the form of a geared engine. The engine forming the driving device 13 may be switched on manually by means of switches on a switchboard and switched off automatically by limit switches activated when the pile supporting surfaces 9 reach the position called for. However, it would also be possible to control he driving device 13 by means of a program device. In order to avoid long interruptions caused by a change of piles, two carriage-like pile supporting surfaces 9 are provided for each feeding apparatus and are alternately positioned on the lifting table 5 and respectively put in a waiting position beside the feeding apparatus where a new pile 6 can be loaded on. The rails 11 consist of a middle section 11*a* crossing the lifting table 5, and two side sections 11*b* running out of the feeding apparatus through the side openings of the portal-like machine frame 2. The rolls 10 of the carriage-like pile supporting surfaces 9 running on the rails 11 may hereby have a rim engaging laterally over the rails 11. The side openings of the poprtal-like machine frame 2 hereby form an ingoing or outgoing opening respectively for the pile supporting surfaces 9.

Each time the piles are changed both pile supporting surfaces 9 are coupled with the tugging device 12 so that the ingoing and outgoing process take place simultaneously. For this purpose the tugging device 12 has two branches 12*a* and 12*b* respectively which project laterally over the lifting table 5, belong to both side sections 11*b* of the rails 11, and bridge each a distance of at least one length of a carriage so that the carriage-like pile supporting surfaces 9 coupled herewith can, in their end positions, be reliably positioned on the lifting table 5 and respectively made to disengage with the lifting table 5. The tugging device 12 of the rails 11 may consist of one or more parts.

In the working example shown in the FIGS. 1 and 2, the tugging device 12 consists of a single-part circulating element 16 which, at right angles to the longitudinal axis of the feeding apparatus, runs through the space of the machine frame respective to the lifting table 5, projects laterally over the lifting table 5, and runs over guide rollers 14 forming the laterally outer ends of the tugging device 12. Said guide rollers 14 rest on bearing blocks 15 supported on the floor. One of the two guide rollers 14 can be driven by means of the driving device 13. As can be best seen in FIG. 4, the circulating element 16 may be in the form of an endless chain. In this case, the guide rollers 14 are in the form of chain wheels. The upper strand of the circulating element 16 running over the guide rollers 14 has two dogs 17 attributed to both carriage-like pile supporting surfaces 9 which, when the piles are changed, engage with a respective coupling element 18 attached to a pile supporting surface 9. Both carriage-like pile supporting surfaces 9 can thus be moved in the one and respectively the other direction by means of the tugging device 12. The dogs 17 on the upper strand of the circulating element 16 and the coupling elements 18 on the respective pile supporting surface 9 are so positioned that, when the pile supporting surface 9 driven out of the machine frame 2 has reached its lateral end position, the other pile supporting surface 9 is centrally positioned on the lifting table 5 and vice versa. A limit switch 51 may be provided for detecting the proper position of pile supporting surface 9 on lifting table 5 and to stop driving device 13, as seen in FIG. 2.

In order to avoid collisions with the lifting table 5 which can be lifted or lowered respectively, the circulating element 16 running through the machine frame 2 is located in front of the front stops 8 as can be best seen in FIG. 2. The dog 17 (FIG. 1 on the right) respective to the carriage positioned on the lifting table 5 is still outside the machine frame 2 in the ingoing position. Thus, the coupling elements 18 are located at the edge of the carriage which is at the back in the ingoing direction, and connected with the respective carriage by means of a support 19 which is bent here and, in the ingoing position, projects out of the machine frame 2 via the adjacent side opening.

As can be best seen in FIG. 4, the dogs 17 are in the form of bars which are located between two chain links and have a hole 20 with a vertical axis. The coupling elements 18 are in the form of pivots with a vertical axis so that edges of contact result in the lifting and respectively lowering direction of the lifting table 5. The coupling element 18 of the carriage-like pile supporting surface 9 positioned on the lifting table 5 is thus automatically lifted out of the hole 20 of the respective dog 17 when the lifting table 5 is lifted, and put into the hole 20 of the respective dog 17 when the lifting table 5 is lowered. The pivot forming the respective coupling element 18 may be conically chamfered at its bottom in order to facilitate moving into the respective hole 20.

In order to fix the pile supporting surface 9 positioned on the lifting table 5 to the latter, a locking device is provided consisting of a bolt 21 of the lifting table 5 and a counter support 22 of the carriage. Said counter support 22 is in the form of an angle piece which is fixed to the bottom of the carriage and the lower bar of which has a recess. The bolt 21 is in the form of a pivot which can be put into said recess and, by means of a crosspiece engaging over the lower bar of the counter support 22, is connected with a foot 23 which is fixed to the lifting table 5 by means of a socket and runs through the lifting table 5 in the lifting and respectively lowering direction. When the lifting table 5 is lowered, the bottom end of said foot 23 runs up against the floor 1 thus causing the bolt 21 of the lifting table 5 to disengage with the counter support 22 of the carriage. When the lifting table 5 is lifted, the bolt 21 moves into the respective recess of the counter support 22. Quite often the force of gravity is hereby sufficient as a holding-down force. In the working example shown here, there is an additional retaining spring 24 acting on the crosspiece.

The respective empty pile supporting surface 9 is usually loaded manually by piling up smaller packets of sheets to a pile 6. In order to guarantee a high piling-up accuracy, there may be a pre-piling device 25, as already known, with front stops 26 parallel to the front stops 8 of the feeding apparatus, and side stops 27 vertical hereto. In the working example as shown in the FIGS. 1 and 2, with both pile supporting surfaces 9 being uniformly moved into the one or the other direction and thus, when empty, being situated on different sides of the machine frame 2, the machine frame 2 of the feeding apparatus is flanked by two pre-piling devices 25, i.e. each of the two branches 12*a* and respectively 12*b* of the tugging device 12 has a pre-piling device 25. When the respective empty pile supporting surface 9 is loaded, the sheet packets piled up manually rest against the front stops 26 with their front edge, and against one side stop 27 with a side edge. If there's only one side stop 27, it is on the side of the lateral pull guide of the feeding apparatus. In the working examples shown in the FIGS. 1 and 2, there are two side stops 27.

As can be best sen in FIG. 3, the pre-piling devices 25 each also include a frame 28 which is supported on the floor and accommodates a turning frame 29 which cooperates with the front stops 26 and respectively the side stops 27. Said turning frame 29 is connected with the frame 28 by means of two parallel rocking levers 30. By activating the rocking levers 30, the turning frame 29 can be moved from the position indicated in FIG. 3 by unbroken lines, where pile 6 is disposed between stops 26 and frame 29, back to the position indicated in FIG. 3 by dash-dotted lines. The staggering against both end positions resulting herefrom is somewhat greater than the width of the ledge forming the side stop 27. By turning back the frame 29, the pile 6 which is complete and rests against the stops 26 and respectively 27 of the pre-piling device 25 can thus be released for retracting, whereby the sheets forming the pile 6 are protected and the accuracy of piling is maintained. In order to make the turning frame 29 turn, there may be a cylinder piston unit 31 which acts on one rocking lever 30 and is supported on the frame 28. The cylinder piston unit 31 is activated before the tugging device 12 of the respective driving device 13. The switching operations required can be effecteds by one and the same switch. In order to protect the edges of the pile even more and to maintain the accuracy of piling, the pre-piling devices 25 are so arranged that, in working position, their front stops 26 are already staggered slightly backwards against the front stops 8 of the feeding apparatus, lest the edges of one pile 6 move against the front stops of the feeding apparatus while the retraction takes place. In the working example shown in the FIGS. 1 and 2, the lower ends of the front stops 26 and respectively the side stops 27 come to an end with the tugging device 12 arranged in front of the front stops 8 in order to prevent collisions above the supports 19 respective to the coupling elements 18 of the carriage.

In the working example shown in the FIGS. 5 to 8, there are also two carriage-like pile supporting surfaces 9 which are alternately loaded in a pre-piling device 25 and respectively positioned on the lifting table 5 for unloading. In this working example contrary to the working example shown in the FIGS. 1 and 2, there is only one pre-piling device 25 which is located on one side of the machine frame 2. The design and workings of said pre-piling device 25 may correspond to the design and workings of the above working example shown in FIG. 3. As, in this case, there is only one pre-piling device 25, the loading of both pile supporting surfaces 9 here takes place at one and the same spot in any case. For this purpose the respective empty, carriage-like pile supporting device 9 which, just as in the working example shown in FIGS. 1 and 2, first moves out in the same direction as the pile supporting surface 9 loaded with a pile 6, is retracted, then, when the lifting table 5 has enough ground clearance, moves under the lifting table 5 into the pre-piling device 25 which is located only on one side. The area of the floor 1 opposite the pre-piling device 25 respective to the machine frame 2 of the feeding apparatus hereby serves as a parking place 32 for the intermediate parking of the respective empty pile supporting surface 9. In the working example shown in the FIGS. 5 to 8, the area of the floor 1 on the left of the machine frame 2 of the feeding apparatus is in the form of the parking place 32. The pre-piling device 25 is located in the area of the floor 1 on the right respective to the machine frame 2 of the feeding apparatus.

The retracting mechanism of the two pile supporting surfaces 9 which move in and out via the side openings of the portal-like frame 2 opposite each other, contains besides the rails located at right angles to the longitudinal axis of the feeding apparatus and consisting of several sections 11*a*, 11*b* as above, two circulating elements 33 and 34 respectively, which are separated from each other, form the two lateral branches 12*a* and respectively 12*b* of the tugging device 12, are located near the floor 1 at the same level, and can be driven synchronously in the same direction. The two circulating elements 33 and 34 respectively which, as can be best seen in FIG. 6, may be in the form of endless chains, run each over a guide roller 35 near the feeding apparatus and a guide roller 36 distant from the feeding apparatus. Each of the circulating elements 33 and 34 respectively has two dogs 37 which are each located at half length of the respective circulating elements 33 and 34 respectively. The two circulating elements 33 and 34 respectively are so adjusted that their dogs 37 move in phase. This means that all dogs 37 of the two circulating elements 33, 34, after each half cycle of the circulating elements 33, 34, are situated in a plane containing the axes of the guide rollers 35, 36, i.e. at an apex of their path of motion returned at the guide rollers 35, 36. Each of the two carriage-like pile supporting surfaces 9 has two coupling elements 38 accommodated on supports 39 which project over the back and front edges of the carriage as seen in the ingoing and respectively the outgoing direction, and are fixed to the carriage. The supports 39 are of such length that the center-to-center distance of the dogs 37 of a pile supporting surface 9, which are fixed hereto, corresponds to the center-to-center distance of the facing dogs 37 of the two circulating elements 33 and 34 respectively in their respective inner apex position. For this purpose, the respective inner guide rollers 35 of the two circulating elements 33 and 34 respectively are arranged at a distance from each other corresponding to the center-to-center distance of both coupling elements 38 of a pile supporting surface 9 plus a diameter of the guide rollers of the same diameter. The front and back supports 39 may be of different or of the same length. In the working example shown here, the supports 39 are of the same length so that the inner guide rollers 35 of the two circulating elements 33, 34 are at the same distance from the respective adjacent lateral edge of the lifting table 5.

The coupling elements 38 are in the form of forks open at the bottom and with a U-shaped cross section. As can be best seen in FIG. 9, the dogs 37 are in the form of pivots fixed laterally to the chain forming the circulating elements 33 or 34 respectively. In the working example shown here, the pivots forming the dogs 37 have two holes which are situated at the distance of the joints of the chain and through which pass the pins 40 forming the axes of the chain joints. The diameter of the pivots forming the dogs 37 corresponds to the inside diameter of the forks forming the coupling elements 38 plus a slight running clearance. The clear depth of the respective slot of the coupling elements 38 bounded by the two fork prongs corresponds approximately to the radius of the return of the path of motion plus a slight projecting length, so that the dogs 37 in their apex position are only just embraced by the lower ends of the fork prongs, and have a sufficient depth of immersion in their further motion. The fork prongs of the coupling elements 38 have flanks running in the lifting and lowering direction of the lifting table 5. Thus, the coupling element 38 of a pile supporting surface 9 positioned on the lifting table 5 can be made to engage and disengage with the dogs 37 at rest by means of the lifting and lowering motion of the lifting table 5. On the other hand, if the drive of the circulating elements 33 and 34 respectively is at the apex of their return motion, the dogs 37 can move out of the coupling elements 38 and respectively move into them.

In the starting position as shown in FIG. 5, with one pile supporting surface 9 positioned on the lifting table 5 and one pile supporting surface 9 in waiting position at the pre-piling device 25, all dogs 37 of the two circulating elements 33 and 34 are in their apex position. In order to change the piles, the lifting table 5 is lowered to the level of the floor 1 whereby the coupling elements 38 of the pile supporting surface 9 which are open at the bottom and are positioned on the lifting table 5 are pushed onto and made to engage with the close to the feeding apparatus dogs 37 of the circulating 33 and 34, which are in coinciding position beneath the pile supporting surface 9. The distance from the feeding apparatus dog 37 of the circulating element 33 of the pre-piling device 25 is only just in engagement with the distant from the feeding apparatus coupling element 38 of the pile supporting surface 9 loaded with a pile 6 at the pre-piling device 25. FIG. 5 shows this operating position. As soon as this operating position is reached, both pile supporting surfaces 9 move in a direction from the pre-piling device 25 to the parking place 32, from right to left as in the working example shown in FIG. 5, whereby the empty pile supporting surface 9 moves out of the machine frame 2, and the pile supporting surface 9 loaded with a pile 6 moves into the machine frame 2 in the same direction and synchronously, and is positioned on the lifting table 5. For this purpose, the driving device 13 of the tugging device 12 is so activated that the two circulating elements 33 and 34, at their upper strand, move each in the direction of the arrow 41, i.e. from right to left as seen in FIG. 5. The distant from the feeding apparatus dog 37 of the pile supporting surface 9 of the pre-piling device 25, which hereby moves upwards over its apex position, thus moves between the fork prongs of the back coupling device 38 of the pile supporting surface 9 which is located at the pre-piling device 25. The same happens to the close to the feeding apparatus dog 37 of the circulating element 34 of the parking place 32, which moves into the front coupling element 38 of the empty pile supporting surface 9 of the lifting table 5. At the same time, the back coupling element 38 of this pile supporting surface 9 disengages with the close to the feeding apparatus dog 37 of the circulating element 33 of the pre-piling device 25, which moves downwards over its apex. As the motion continues, the empty pile supporting surface 9 is pulled out of the machine frame 2 and the pile supporting surface 9 loaded with a pile 6 is pushed into the machine frame 2 until the dogs 37 reach the apex position shown in FIG. 7 where the pile supporting surface 9 loaded with a pile 6 is positioned on the lifting table 5, and the empty pile supporting surface 9 is parked at the parking place 32 opposite the pre-piling device 25. In this working position, limit switches which can be activated by one of the two pile supporting surfaces 9 stop the driving device 13. Then the lifting table 5 can be lifted for processing the driven-in new pile 6 whereby, as can be seen in FIG. 8, both coupling elements 38 of the pile supporting surface 9 positioned on the lifting table 5 automatically disengage with the dogs 37 of the two circulating elements 33 and 34, which are near the feeding apparatus and are located in the inner apex position. As soon as the lifting table 5 has enough clearance, the empty pile supporting surface 9 waiting at the parking place 32 can move under the lifted lifting table 5 into the pre-piling device 25 opposite the parking place 32 by activating the tugging device 12 in the opposite direction of the retracting process. In the middle position, i.e. in a position coinciding with the pile supporting surface 9 positioned on the lifting table 5 where all dogs 37 are in their apex position again, the pile supporting surface 9 which has passed under the lifting table 5 is handed over from the circulating element 34 of the parking place 32 to the circulating element 33 of the pre-piling device 25. Hereby, the close to the feeding apparatus dog 37 of the circulating element 34 of the parking place 32 moves out of the respective coupling element 38, and the close to the feeding apparatus dog 37 of the circulating element 33 of the pre-piling device 25 moves into the respective coupling element 38. The handing-over of the empty pile supporting surface 9 from the circulating element 34 to the circulating element 33 may take place without interruption of the drive. Thus, the drive is only stopped when the dogs 37, after handing over the empty pile supporting surface 9 to the circulating element 33 of the pre-piling device 25, reach their further apex position where the empty pile supporting surface 9 has moved into the pre-piling device 25 and a dog 37 each is in a waiting position coincidingly below the coupling element 38 of the pile supporting surface 9 positioned on the lifting table 5 so that the working position as shown in FIG. 5 is reached when the lifting table 5 is lowered.

For securing the mobile pile supporting surface 9 positioned on the lifting table 5, there is a locking device of which the design and workings correspond to the locking device already described in the FIGS. 1 and 2 being in the form of a counter support 22 formed by an angle piece, and a bolt 21 which is fixed to a crosspiece engaging over the lower bar of the angle piece, which has a recess. FIG. 8 shows the working position in which the bolt 21 engages with the counter support 22. In the FIGS. 5 and 7, the bolt 21 has been made to disengage with the counter support 22 by the effect of the foot passing through the lifting table 5.

The rolls 10 of the mobile pile supporting surface 9 may run on the floor 1. In the working example shown here as has been mentioned further above, there are rails 11 divided into a middle section and two lateral sections. In this case, the rolls 10 of the mobile pile supporting surface 9 have a lateral rim. In the working position as seen in FIG. 5 with the lifting table 5 in its bottom position, the top edges of the lateral rail sections **11*b* are in alignment with the top edges of the middle rail section 11***a* passing over the lifting table 5. In order to make sure that, when the empty pile supporting surfaces 9 are driven from the parking place 32 back to the pre-piling device 25, there is also a ridgeless path of a rails, a level equalizer is provided. In the working example shown here, said equalizer, as can be best seen in FIG. 8, consists of a bridge 42 which is located coincidingly below the lifting table 5 and can be lowered by a measure corresponding to the thickness of the lifting table 5 plus the rails on it. The bridge 42 has rail sections 11*a* corresponding to the rail section 11*a* of the lifting table 5. For lifting and respectively lowering the bridge 42, the latter is hinded on two guide rods 43 which, on the other hand, are hinged on a respective pivoted rocking arm 44. In the upper position where the top edges of the rail sections 11*a* are in alignment with the top edges of the lateral rail sections 11*b*, the guide rods 43 and the rocking arms 44 are in or near their stretched position as can be seen in FIG. 8. In the lowered position, the guide rods 43 and the rocking arms 44 are in a bent position as is shown in the FIGS. 5 and 7. In the lower position, the bridge 42 may rest against stops 45. The bridge 42 is lowered by the lifting table 5 against the force of a spring 46 acting on one of the rocking arms 44, to its lower position where the top edges of the rail sections 11*a* of the lifting table 5 are in alignment with the top edges of the lateral rail sections 11*b* as can be seen in the FIGS. 5 and 7. As soos as the lifting table 5 is lifted, the bridge 42 follows this motion until the guide rods 43 and the rocking arms 44 reach their stretched position.

As can be best seen in FIG. 6, the coupling elements 38 of the carriage and the dogs 37 of the tugging device 12 are situated behind the front stops 8 of the feeding apparatus, i.e. in the area given by the side openings of the portal-like machine frame 2, in order to make sure that the respective empty pile supporting surface 9 moves back from the parking plate 32 to the pre-piling device 25. In the working example shown here, the coupling elements 38 are arranged centrally respective to the width of the carriage so that a central traction results. In order to avoid collisions with the lifting table 5, the close to the feeding apparatus guide rollers 35 of the two circulating elements 33 and 34 are beside the lateral edges of the feeding apparatus. Both circulating elements 33 and 34 may have single drives in the form of two motors which are electrically connected with each other to make the two circulating elements 33 and 34 run synchronously and in the same direction. In the working example shown here, the two circulating elements 33 and 34 of the tugging device 12 are drivingly connected with each other in a mechanical way. To achieve this, there is a circulating element 46 which bridges the distance between the close to the feeding apparatus guide rollers 35, is advantageously also in the form of a chain, and runs over guide rollers 47 coaxial with the close to the feeding apparatus guide rollers 35 of the circulating elements 33 and 34. The guide rollers 47, together with the adjacent guide rollers 35 of the circulating elements 33 and 34, are accommodated on respective mutual shafts 48 of which one may be connected with the geared engine forming the driving device 13 so that one engine can drive both circulating elements 33 and 34. The shafts 48 carrying the guide rollers 35 and 47 may be accommodated on bearing blocks supported on the floor 1, the same as the shafts carrying the guide rollers 36 which are distant from the feeding apparatus. The circulating element 46 in the middle which has no dogs is situated between the rails 11. In order to avoid collisions with the lifting table 5 and respectively the bridge 42, the middle circulating element 46 runs under the lifting table 5 and respectively the bridge 42. For this purpose, guide rollers 50 are provided in the cavity 49 of the bridge 42.

The cycle of motion of the circulating elements 33 and 34 comprises half the length of each of the two circulating elements 33 and 34 respectively, which may be of the same length. In such a case, the circulating element 46 in the middle which has no dogs effects a mutual driving connection with the transformation ratio 1. In order to save space at the parking place 32, the respective circulating element 34 of the two-branched tugging device 12 may be shorter than the circulating element 33 of the pre-piling device 25 as it is sufficient for the back of the empty pile supporting surface 9 which has moved out, to be just out of collision reach with the front of the pile supporting surface 9 which has moved in. In this case, a phase coincidence of the two circulating elements 33 and 34 is reached when, by means of the circulating element 46 in the middle, a reduction of gear results which corresponds to the length ratio of the two lateral circulating elements 33 and 34. To achieve this, the dimension of the guide rollers 47 merely has to chosen correspondingly.

I claim:

1. A sheet feeding apparatus having a longitudinal axis arranged on a planar floor with a lifting table having a defined surface area which can be lowered to the plane of the floor and serves to take up at least one pile supporting surface loaded with a pile of sheets, whereby the at least one pile supporting surface is formed as a mobile carriage with rolls and with at least one coupling element and a countersupport fixed thereto, and there is a carriage retracting mechanism with a tugging device for moving said at least one pile supporting surface along a direction of motion which is located on the floor, said tugging device having a reversible driving device, bridging a distance of at least one length of a carriage, being situated outside the surface area of the lifting table, and having at least one dog able to engage and disengage, by the lifting or respectively lowering motion of the lifting table, with the at least one coupling element, said at least one coupling element having edges of contact parallel to the lifting or respectively lowering direction of the lifting table and projecting over the surface area of the table when the at least one pile supporting surface is on the table, said at least one mobile pile supporting surface positioned on the lifting table can be locked to the latter by means of a bolt which is accommodated thereon, said bolt having edges of contact parallel to the lifting or respectively lowering direction of the lifting table, and being made to engage and disengage with the countersupport by the lifting or respectively lowering motion of the lifting table oppositely directed to the engagement of the at least one dog with the at least one coupling element.

2. The apparatus as claimed in claim 1, which further includes a foot having upper and lower ends, said bolt being fixed to the upper end of the foot which passes over the countersupport, the lower end of the foot passing through the lifting table and running against a solid stop when the lifting table is lowered.

3. The apparatus as claimed in claim 1 whereby the tugging device is at right angles to the longitudinal axis of the feeding apparatus.

4. The apparatus as claimed in claim 3 whereby said at least one dog is a plurality of dogs and said at least one pile supporting surface is two pile supporting surfaces, the tugging device has two branches which, in relation to the lifting table, are opposite each other, said two branches each having at least one dog of said plurality of dogs and being provided with one of said two mobile pile supporting surfaces transportable by said at least one dog of said plurality of dogs.

5. The apparatus as claimed in claim 1 whereby the retracting mechanism has rails which run parallel to the tugging device, pass over the lifting table which has side edges, are divided at the side edges of the lifting table, and on which run the rolls of the at least one mobile pile supporting surface.

6. The apparatus as claimed in claim 4 whereby the tugging device is in the form of a single-part circulating element which is situated outside the surface area of the lifting table, runs over guide rollers, is preferably in the form of a chain, cooperates with two pre-piling devices opposite each other at the same lateral level staggering against the lifting table as well as with the two mobile pile supporting surfaces each having, at their front sides turned away from each other, said at least one coupling element cooperating with said at least one dog of the circulating element.

7. The apparatus as claimed in claim 6 whereby the coupling elements are in the form of pivots each having a contour with a vertical axis fixed to supports, and the dogs in the form of bars each with a recess corresponding to the contour of the pivot.

8. The apparatus as claimed in claim 4 wherein said at least one dog of said plurality of dogs is two dogs and said at least one coupling element is two coupling elements and whereby each branch of the tugging device is in the form of a single-part circulating element, said branches which, in relation to the lifting table, being opposite each other, running at right angles to the longitudinal axis of the feeding apparatus running over guide rollers placed behind each other at the same level which define respective inner and outer apexes of the circulating elements, being drivingly connected with each other, and each having said two dogs which synchronously run through respective said inner and outer apexes of the circulating elements and wherein a distance is defined between corresponding dogs of said circulating elements which run through the inner apexes facing each other of the two circulating elements, and whereby each one of said two pile supporting surface has said two coupling elements whose distance from one another corresponds to the distance of the corresponding dogs which synchronously run through the inner apexes facing each other of the two circulating elements.

9. The apparatus as claimed in claim 8 whereby the dogs are in the form of pivots laterally projecting over the circulating elements and having a diameter, and the coupling elements in the form of forks with a U-shaped cross section having a slot open at the bottom and an inside length of at least the radius of a curve drawn by the dogs at their guide rollers, and of which the inside diameter corresponds at least to the diameter of the pivot-like dogs.

10. The apparatus as claimed in claim 8 whereby one circulating element of the two-part tugging device is attributed to a pre-piling device, and the other circulating element to a parking place opposite the pre-piling device.

11. The apparatus as claimed in claim 8 whereby, below the lifting table which has a thickness and rail sections, there is a bridge which can be lifted and lowered by the thickness of the lifting table, and preferably has rail sections coincidingly arranged below the rail sections of the lifting table.

12. The apparatus as claimed in claim 8 whereby the two circulating elements with said two dogs of the two-part tugging device are drivingly connected with each other by means of a middle circulating element without dogs which preferably is in the form of a chain and runs over guide rollers which, each together with a close to the feeding apparatus guide roller of the lateral circulating elements, are accommodated on a mutual shaft.

13. The apparatus as claimed in claim 8 whereby the coupling elements of the pile supporting surfaces which have a longitudinal axis are each located approximately at the longitudinal axis of the pile supporting surfaces.

14. The apparatus as claimed in claim 12 whereby the middle circulating element runs below the floor at the surface area of the lifting table.

15. The apparatus as claimed in claim 10 whereby the circulating element associated with the parking place is shorter than the circulating element associated with the pre-piling device and at the same ratio can be driven more slowly.

16. The apparatus as claimed in claim 1 whereby the driving device of the tugging device can be stopped by means of limit switches activated by the dogs.

* * * * *